US007793512B2

(12) United States Patent
Kearney et al.

(10) Patent No.: US 7,793,512 B2
(45) Date of Patent: Sep. 14, 2010

(54) MULTIPLE SELF CLEANING ORIFICE THERMAL EXPANSION DEVICE

(75) Inventors: Daniel J. Kearney, Ulster Park, NY (US); Mark A. Marnell, Kingston, NY (US); Lawrence F. Palmer, Hyde Park, NY (US); Donald W. Porter, Highland, NY (US); Randy J. Zoodsma, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 588 days.

(21) Appl. No.: 11/425,164

(22) Filed: Jun. 20, 2006

(65) Prior Publication Data

US 2007/0289329 A1 Dec. 20, 2007

(51) Int. Cl.
*F25B 41/04* (2006.01)

(52) U.S. Cl. ..... 62/222; 62/223; 62/224; 62/527; 62/528

(58) Field of Classification Search ..... 251/129.09, 251/129.15, 129.16, 129.17, 129.2, 129.22, 251/122, 215, 226, 227; 62/222, 197, 198, 62/199, 200, 204, 205, 206, 218, 210, 211, 62/212, 223, 224, 195, 527, 528
See application file for complete search history.

(56) References Cited

U.S. PATENT DOCUMENTS

| | | | | |
|---|---|---|---|---|
| 2,845,939 | A * | 8/1958 | Bayer | 137/118.04 |
| 4,523,739 | A | 6/1985 | Johansen et al. | 251/139 |
| 4,768,558 | A * | 9/1988 | Weber | 137/862 |
| 5,044,555 | A | 9/1991 | Youngeberg et al. | 239/117 |
| 5,299,740 | A | 4/1994 | Bert | 239/117 |
| 5,341,832 | A | 8/1994 | Foust | 137/202 |
| 5,419,531 | A * | 5/1995 | Hoehn | 251/122 |
| 5,715,704 | A | 2/1998 | Cholkeri et al. | 62/527 |
| 6,289,930 | B1 * | 9/2001 | Simon | 137/601.14 |
| 6,374,624 | B1 | 4/2002 | Cholkeri et al. | 62/222 |
| 6,701,744 | B1 * | 3/2004 | Yajima et al. | 62/502 |
| 2002/0139138 | A1 * | 10/2002 | Repice et al. | 62/525 |
| 2003/0159453 | A1 | 8/2003 | Ott et al. | 62/222 |

* cited by examiner

*Primary Examiner*—Cheryl J Tyler
*Assistant Examiner*—Justin Loffredo
(74) *Attorney, Agent, or Firm*—Geraldine Monteleone, Esq.; Kevin P. Radigan, Esq.; Heslin Rothenberg Farley & Mesiti P.C.

(57) ABSTRACT

A multiport expansion device for vapor compression refrigeration systems is provided having improved reliability by preventing orifice fouling by virtue of its mechanical design. Furthermore, multiple arrays of ports of two or more similar or differently sized port holes is contemplated which allows further reliability based on redundant orifices and pin combinations.

14 Claims, 7 Drawing Sheets

MULTIPLE SELF CLEANING ORIFICE THERMAL EXPANSION DEVICE

TECHNICAL FIELD

This invention relates in general to cooling and refrigeration systems incorporating expansion valves. More particularly, the present invention is directed to an expansion apparatus incorporating a plurality of orifices at least one of which is provided with a self-cleaning pin.

BACKGROUND OF THE INVENTION

The present invention is directed to refrigeration systems and methods in which a cooling effect is provided by an isenthalpic pressure drop between isolated volumes. The expansion occurs as part of a vapor compression and expansion cycle. However, the expansion process through an orifice (also referred to herein as a channel) can suffer from reliability problems. In particular, refrigeration systems using a vapor compression and expansion cycle are susceptible to fouling failures which occur at the expansion device (that is, at the isenthalpic pressure drop point). The expansion devices in prior systems typically include capillary tubes and fixed sized orifices which do not provide any (thermal) control. Other expansion devices include expansion valves in which some valves are controlled via a pressure bulb or via electrical means (such as with a stepper motor). All of these devices require small geometries to accomplish the desired refrigeration expansion or pressure drop. It is at this large pressure drop point with commensurate temperature change which particularly causes impurities to precipitate out and to be deposited on the expansion device's small geometry. Fouling or accumulation of impurities at the expansion device can therefore cause poor performance and even outright failure of the refrigerant cycle.

SUMMARY OF THE INVENTION

The expansion devices described herein prevent fouling at the small geometries by providing a mechanical method to keep surfaces clear with mechanically moving parts. To accomplish this orifice pin assemblies are solenoid controlled. Actuators, such as solenoids, are used to move the pins into and out of the orifices (expansion channels) both to provide control and to clear debris. In addition the expansion device of the present invention provides inherently improved reliability with the inclusion of multiple parallel orifice/pin assemblies. Any one of the orifices is usable continuously in a fully open mode or in a fully closed mode or can also be controlled in a pulse width modulated fashion depending on the type of controller used.

The shortcomings of the prior art are overcome and additional advantages are provided through the use of an apparatus for controlling the expansion of a cooling fluid in a cooling device. A flow barrier having a plurality of channels therein for the expansion of the cooling fluid is provided with a plurality of pins for each one of the channels. The pins are dimensioned so as to substantially seal the said channel against the flow of the fluid. A plurality of actuators, one for each pin moves the pins into and out of the channels.

In another aspect of the present invention, the channels provided do not all have the same size. Thus, if they are round they do not all have the same diameter. If the channels are provided having cross-sectional areas that are proportional to selected exponential powers of 2 or 10, the device is operable to set the rate of expansion to be proportional to any decimal or binary number that a user might wish to provide.

Accordingly, it is an object of the present invention to provide an expansion device for a cooling system which is more reliable than prior designs.

It is also an object of the present invention to provide a mechanism for clearing cooling system expansion orifices.

It is another object of the present invention to provide a cooling system expansion device which is more controllable and flexible in its operation;

It is yet another object of the present invention to provide controllable redundancy in cooling system expansion devices.

It is a still further object of the present invention to provide a method for the intelligent control of a cooling system expansion device.

Lastly, but not limited hereto, it is an object of the present invention to provide the ability to have a cooling system expansion device respond to specifically supplied numerical values.

Additional features and advantages are realized through the techniques of the present invention. Other embodiments and aspects of the invention are described in detail herein and are considered a part of the claimed invention. Furthermore, the recitation herein of a list of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

The invention disclosed herein is a multiport expansion device for vapor compression refrigeration systems in which improved reliability is provided by preventing orifice fouling by virtue of its mechanical design. Furthermore, multiple parallel arrays of ports (an "orifice/pin pair" is referred to herein as a "port") of two or more similar or different diameter port holes is contemplated which allows further reliability based on redundant orifices/pins. For example, if a port fails due to fouling, the next orifice is opened. Each orifice in this two-or-more-port, parallel design uses a solenoid controlled pin that mechanically clears debris that may have accumulated in the orifice when it is in the open position. It is further contemplated that control of the solenoids for the pin/orifice includes sensing for out of temperature regulation conditions. For example, each pin/orifice is periodically closed quickly to clear debris as a recovery action, especially for ports that have been in continuous open mode use for a long time. This is one of the ways that the operation of the expansion device of the present invention is made more susceptible to intelligent control operations.

Figure 7C:
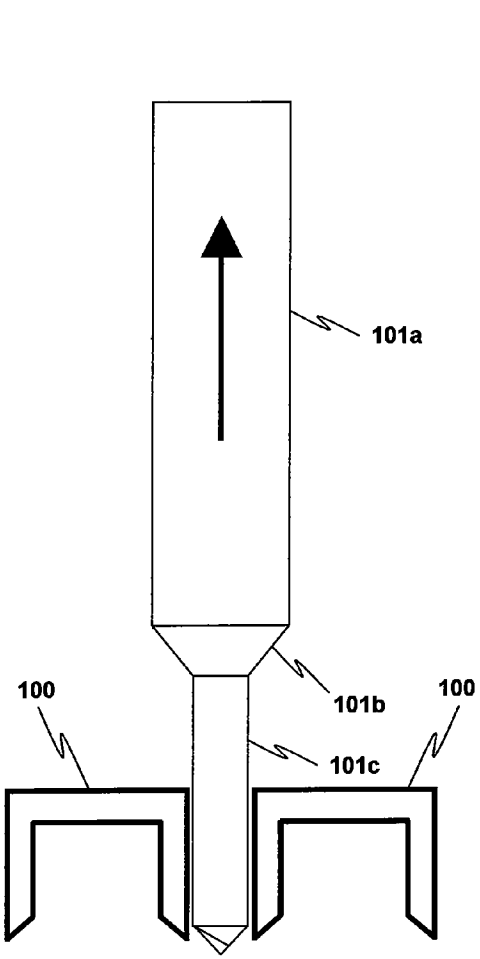
FIG. 7C is a side elevation view illustrating the idea that pin spin does not occur as the pin is withdrawn.
Figure 7B:
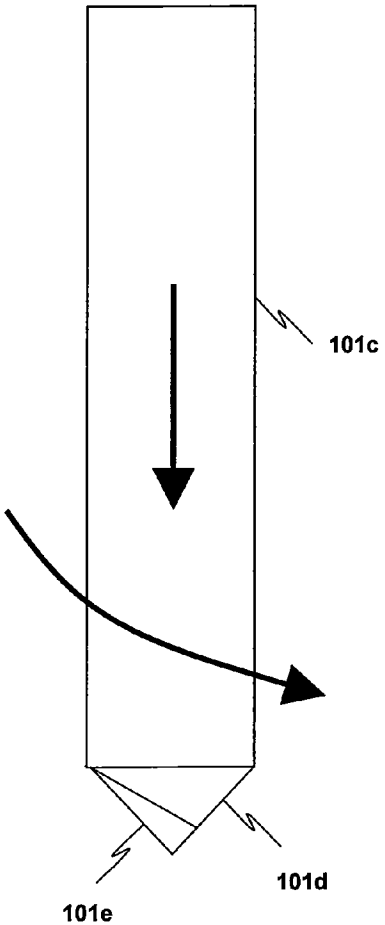
FIG. 7B is a detailed view showing the end of the pin in FIG. 7B.
Figure 7A:
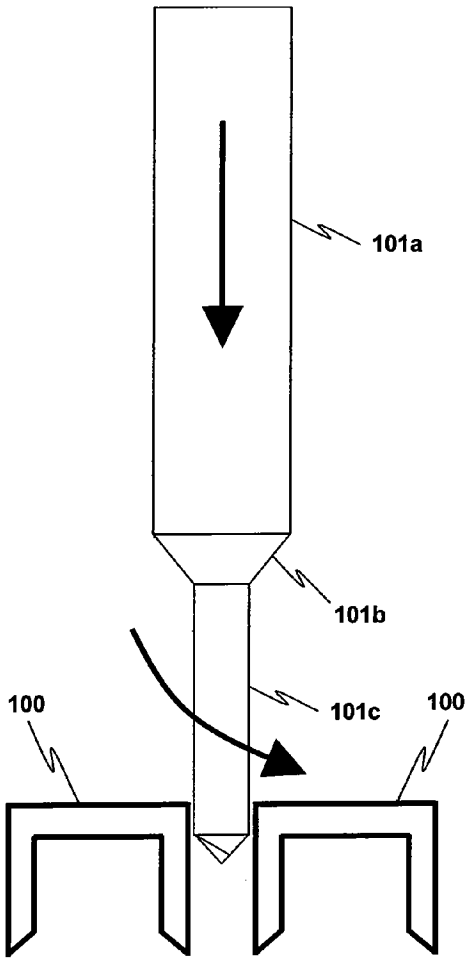
FIG. 7A is a side elevation view illustrating turning action provided by a chamfer at the end of a pin.

The mechanical design of the solenoid driven pins are such that the pin rotates somewhat during linear actuation. This is accomplished by providing an unsymmetrical chamfer (101*e* in FIG. 7B) on the pin assembly.). This further improves device reliability by spreading wear areas around the entirety of the pin's cylindrical surface. Clearly, this embodiment is not applicable to pins having noncircular cross-sections. As seen in FIG. 7A, the feature at the end of pin 101 is similar to the end of a drill bit. This is an area at the tip of the pin with a different slope that causes a small rotational force and thus makes the pin spin. An enlarged view of this feature is shown in FIG. 7B. Furthermore, the rotational force only occurs when pushing the pin through the hole, not when the pin returns back, as suggested by the pin motion arrow in FIG. 7C where there is no corresponding arrow to indicate pin rotation unlike FIGS. 7A and 7B. Therefore, the pin is really spinning and not just wiggling back and forth in a stalled rotary motion.

Figure 1:
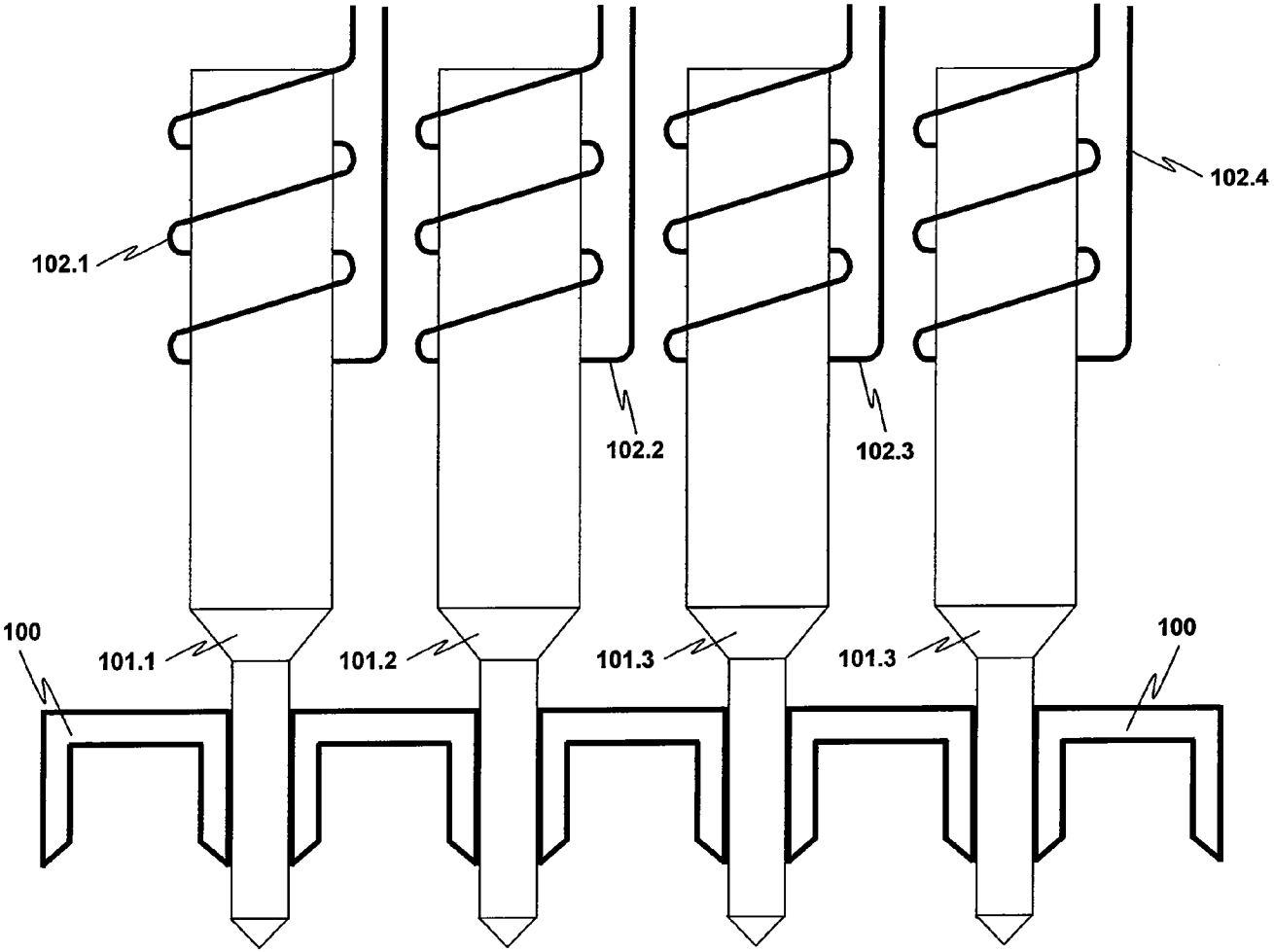
FIG. 1 is a cross-sectional side elevation view illustrating an embodiment of the present invention in which all orifices are closed.
Figure 2:
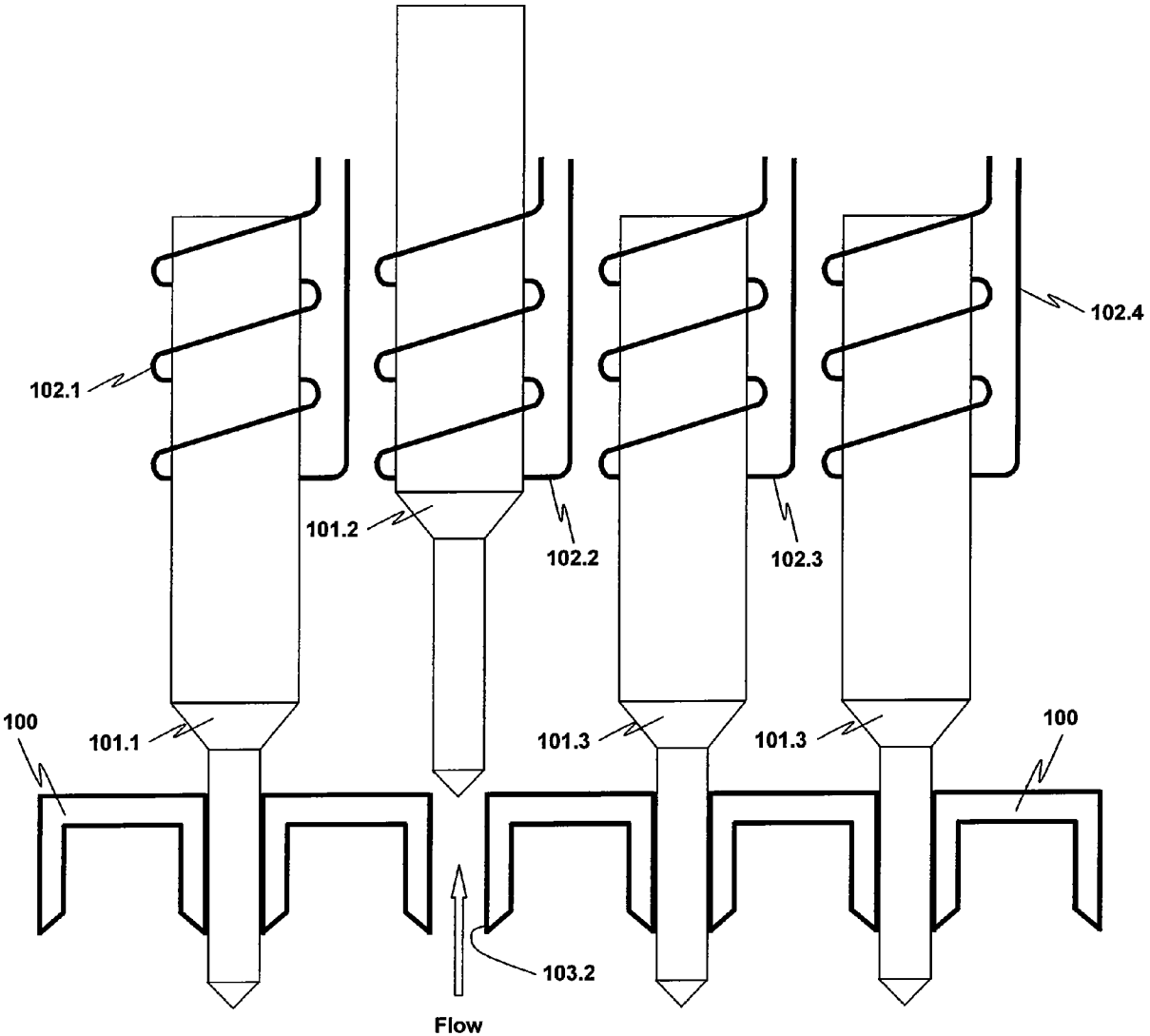
FIG. 2 is a cross-sectional side elevation view illustrating an embodiment of the present invention in which one of the orifices is opened.
Figure 3:
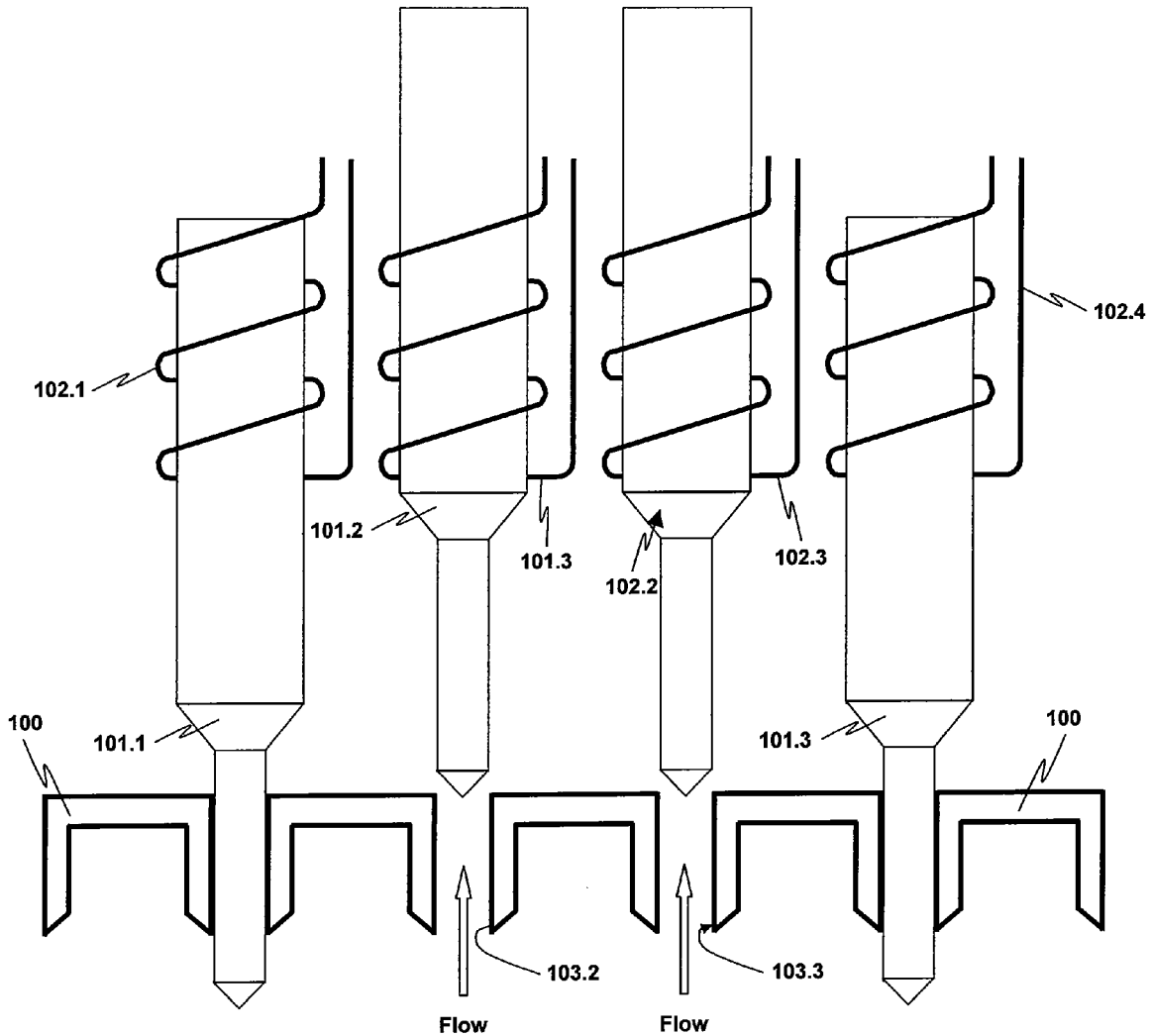
FIG. 3 is a cross-sectional side elevation view illustrating an embodiment of the present invention in which two orifices are opened.
Figure 4:
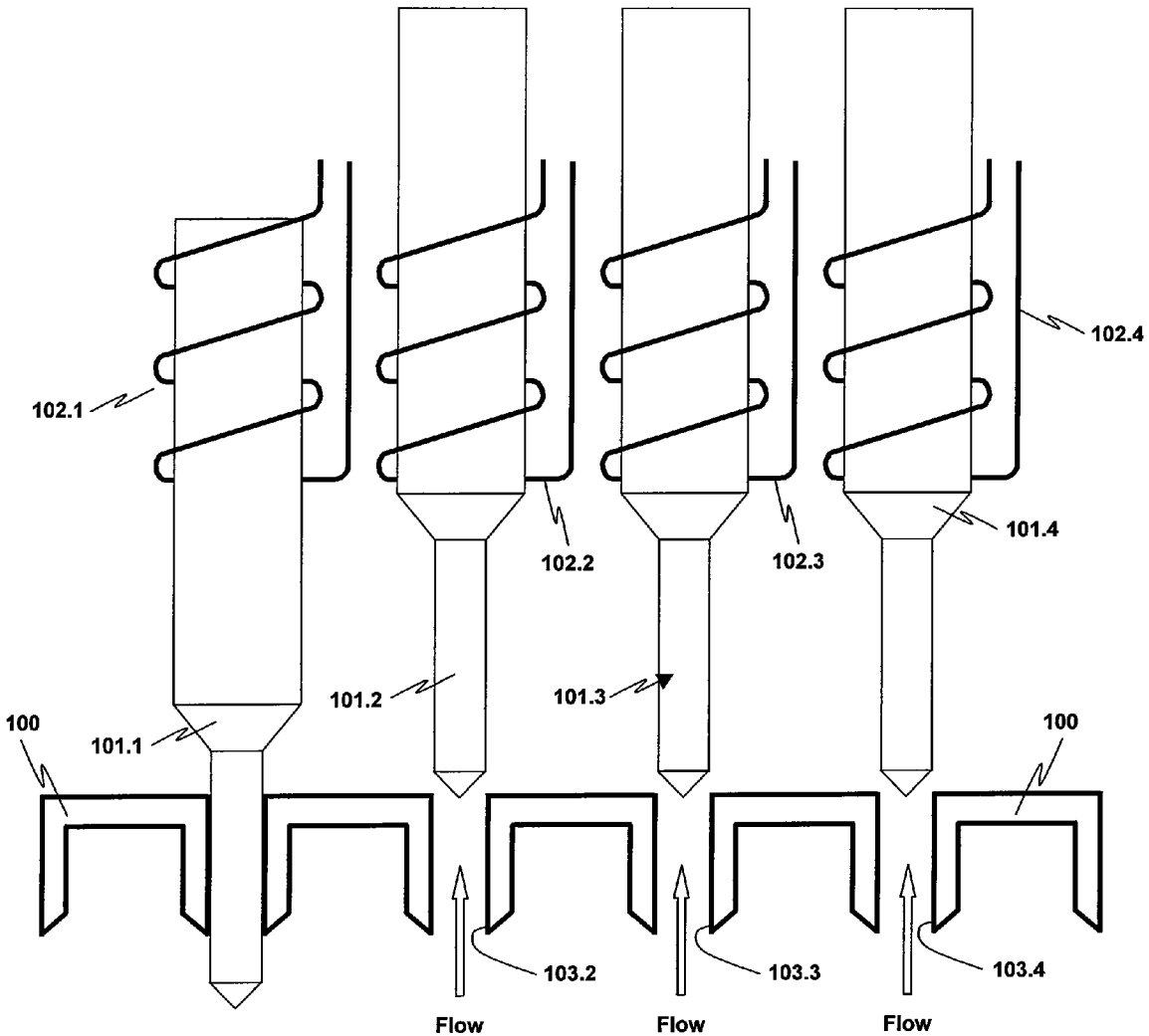
FIG. 4 is a cross-sectional side elevation view illustrating an embodiment of the present invention in which two orifices are opened.

FIG. 1 illustrates an embodiment of the present invention in which all of the pins (101.1 through 101.4) are shown fully inserted within all of the channels (103.1 through 103.4, respectively; see FIGS. 2 through 4 for these reference numerals which are conveniently shown therein). Apertures 103.1-103.4 are present in barrier 100 that exists between two isolated volumes containing the refrigerant (expansive fluid) that flows across barrier 100 through the apertures or channels. Barrier 100 is nonferromagnetic. For example, barrier 100 can be made of brass, bronze, copper or the like. While four aperture/pin combinations are shown, any convenient number may be employed. The construction of pins 101 is shown in detail in FIG. 5 discussed below. Surrounding each pin 101.1-101.4 there is provided a corresponding coil 102.1-102.4. Thus, pins 101 and coils 102 act together as a solenoid. The pin material is ferromagnetic and is therefore magnetically coupled to the coil for controlled motion of the pin. The orientation of the solenoid compared to the bulk of the pin material, along with a spring (not shown) makes the device normally closed or normally opened.

FIG. 2 is similar to FIG. 1 except that pin 101.2 is shown in the fully open position thus permitting expansive fluid flow in the direction shown through aperture 103.2. FIG. 3 is similar to FIG. 2 except that both pins 101.2 and 101.3 are shown in the fully open position thus permitting expansive fluid flow in the direction shown through apertures 103.2 and 103.3. FIG. 4 is similar to FIG. 3 except that now pins 101.2, 101.3 and 101.4 are shown in the fully open position, thus permitting expansive fluid flow in the direction shown through apertures 103.2, 103.3 and 103.4, as shown.

Figure 5:
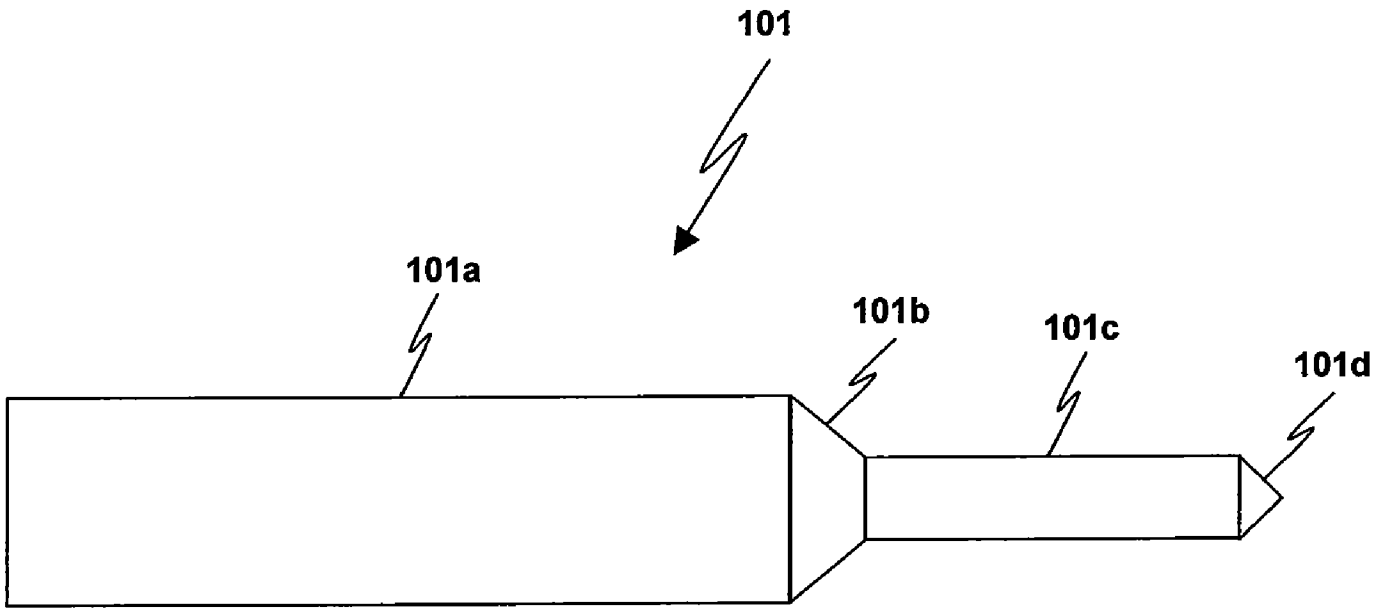
FIG. 5 is a side elevation view illustrating in greater detail the construction of an orifice controlling and cleaning pin.

FIG. 5 is a side elevation view of a pin usable in accordance with the present invention. Each pin 101 includes body portion 101*a* comprising a material that is susceptible to magnetic fields created by coil 102. Optional tapered portion 101*b* provides a transition to a size suitable for insertion into channel (orifice) 103. Insertion portion 101*c* is sized for a tight, sealable insertion into channel 103. Lastly, pin 101 is provided with tip 101*d* to better insure reliable insertion. While tip 101*d* is shown as being substantially as conical, any convenient tapering may be provided.

Figure 6:
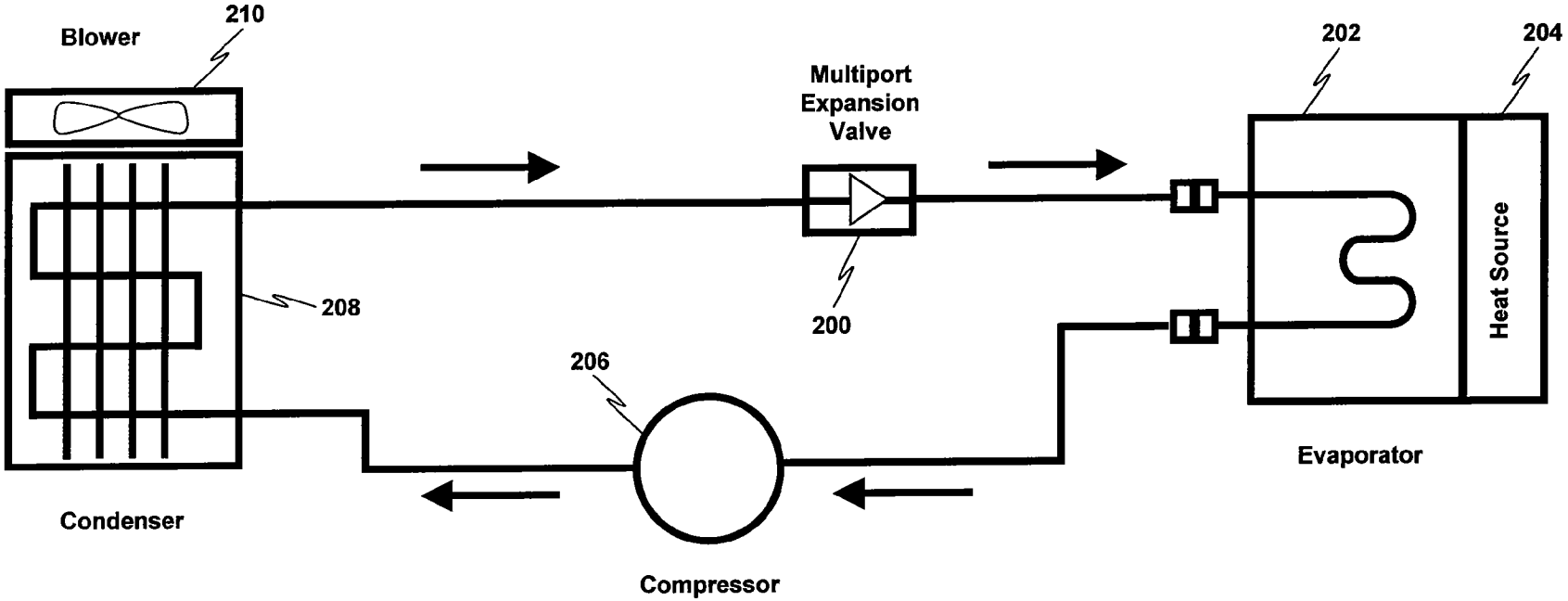
FIG. 6 is a block diagram illustrating a typical cooling system in which the present invention is employed.

FIG. 6 illustrates the relevant portion of a typical environment in which the present invention is employed. It describes a conventional refrigeration system in which a refrigerant is compressed by compressor 206. As a result of the compression it experiences an increase in temperature. Most of this heat is removed by passage through condenser 208 which is typically provided with blower 210 to assist in heat removal by the passage of air over the conduits of condenser 208. From there the refrigerant flows through expansion orifices 200 of the present invention where it expands and cools. From there the refrigerant flows on to evaporator 202 which is in contact with object 204 which is to be cooled. In the present invention this object is typically an electronic circuit device.

The parallel orifice/pin assemblies can be of the same diameter and/or geometry or can be different to provide different weighting factors for refrigerant expansion per each orifice/pin assembly. The diameter and length of each orifice/pin assembly is tunable to provide a range of desirable expansion characteristics. This arrangement is intended to be similar to a "digital to analog converter" (DAC) used in electrical circuits. Not only do the orifice/pin assemblies not have to be of the same size, it is possible to also provide duplicate sizes for purposes of redundancy. Furthermore, while sizes may be selected to provide a match between flow rate and a numerically supplied value in a one-to-one fashion, it is also possible to select the sizes in a fashion which does not provide weighting in the strict polynomial sense of number representation. Rather, it is possible to provide a range of sizes in which multiple combinations of pin positions effectuate the same flow rate, that is, provide the same total area across which expansive flow takes place. In this fashion too, redundancy is provided.

It is noted that the term "actuator" as employed herein is intended to be more general than the term "solenoid. For example, an actuator may include a solenoid together with conventional mechanical linkages which produce a mechanical advantage in moving the pins. Levers and cams are just two examples of such devices. Thus, an actuator is more easily matched to a bias means, such as a spring, used to provide either a normally open or normally closed position.

The solenoids or other actuators employed in the present invention are selected of materials which are compatible with the specific refrigeration fluid or fluids used. However, it is noted that the design of the present system provides protection against fouling by contamination that might be introduced along with the solenoids or actuators. Accordingly, the present invention thus also provides some enhancement for the range of materials that are employable in the solenoids or actuators.

The claims herein refer to the expansion of a fluid as opposed to the expansion of a gas since it is contemplated that the material flowing through the expansion channels may comprise a gas or a multiphase mixture including gas and liquid components.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. A multiport expansion valve for controlling expansion of a fluid in a cooling device, said multiport expansion valve comprising:

a fluid inlet channel and a fluid outlet channel;

a flow barrier disposed between the fluid inlet channel and the fluid outlet channel, the flow barrier having a plurality of expansion orifices therein configured for expansion of said fluid from a first volume on a fluid inlet channel side of said flow barrier to a second volume on a fluid outlet channel side of said flow barrier, and the flow barrier comprising a common surface exposed to the fluid on the fluid inlet channel side of the flow barrier, the plurality of expansion orifices extending through the flow barrier from the common surface of the flow barrier on the fluid inlet channel side thereof;

a plurality of pins, respectively for each of said expansion orifices, each dimensioned to substantially seal said respective expansion orifice against flow of said fluid when closed and to extend through said respective expansion orifice when closed to clear any debris accumulating therein; and a plurality of actuators, respectively for each of said pins, each actuator independently controlling movement of said restrictive pin into and out of its respective expansion orifice, wherein each actuator of the plurality of actuators is a solenoid.

2. The multiport expansion valve of claim 1 in which said pins each have a circular cross-section and an unsymmetrical tip, and wherein the common surface of the flow barrier is a common planar surface.

3. The multiport expansion valve of claim 1 in which at least some expansion orifices of said plurality of expansion orifices each have a different cross-sectional flow diameter and at least some corresponding pins of said plurality of pins each have a different cross-sectional diameter so as to provide a total flow area cross-section across the flow barrier that is controllable to a finer degree in accordance with a desired flow rate, wherein different weighting factors per pin and respective expansion orifice for fluid flow are provided by the different diameters of the at least some orifices and respective pins.

4. The multiport expansion valve of claim 1 in which at least two expansion orifices, and corresponding pins, possess cross-sectional areas of equal size, wherein redundant total flow cross-sectional areas through the flow barrier are provided by the at least two expansion orifices, and their corresponding pins.

5. The multiport expansion valve of claim 1 in which said expansion orifices and said pins are dimensioned to provide multiple combinations of pin insertion states which achieve an equal total flow area cross-section.

6. A method for controlling the expansion of a fluid flowing through a muliport expansion valve comprising a fluid inlet channel, a fluid outlet channel, and a flow barrier disposed between the fluid inlet channel and the fluid outlet channel, the flow barrier comprising a plurality of expansion orifices therein, and comprising a common surface exposed to the fluid on a fluid inlet channel side thereof, the plurality of expansion orifices extending through the flow barrier from the common surface of the flow barrier on the fluid inlet channel side thereof, said method comprising allowing said fluid to pass from a first volume on the fluid inlet channel side of the flow barrier to a second volume on a fluid outlet channel side through one or more of the plurality of expansion orifices in said flow barrier, wherein fluid flow through the plurality of expansion orifices is individually controlled during the allowing by respective actuator driven pins, wherein each pin is individually driven by one of a plurality of actuators, wherein each actuator of the plurality of actuators is a solenoid, and wherein the respective actuator driven pins are each dimensioned to seal the associated expansion orifice against flow of fluid when closed and to extend through the respective expansion orifice when closed to clear any debris accumulating therein.

7. The method of claim 6 further including imparting via a shaped tip a rotary motion to each pin of said pins, and wherein the common surface of the flow barrier is a common planar surface.

8. The method of claim 7 in which said shaped tips facilitate the removal of contamination from said respective expansion orifices.

9. The multiport expansion valve of claim 1 in which said pins are each provided with a shaped tip to facilitate the removal of contamination from said respective expansion orifices.

10. The multiport expansion valve of claim 1 in which said pins and said expansion orifices are dimensioned lengthwise as well as in cross-sectional area so as to provide a finer degree of flow rate control.

11. The multiport expansion valve of claim 9, wherein said plurality of actuators and said shaped tips of said plurality of pins impart a rotational motion to each pin of said plurality of pins when passing linearly into its respective expansion orifice during closing thereof, and wherein no such rotational motion is present when withdrawing linearly out of its respective expansion orifice during opening thereof.

12. The multiport expansion valve of claim 9, wherein the plurality of actuators apply linear activation to the plurality of pins during closing thereof and the shaped tips of the plurality of pins impart a rotational motion to each pin when passing through its respective expansion orifice during closing thereof.

13. The multiport expansion valve of claim 9, wherein the shaped tip of each pin comprises an unsymmetrical chamfer to impart rotational motion to the pin during closing thereof via linear actuation.

14. The multiport expansion valve of claim 1, wherein the plurality of actuators periodically temporarily close each pin against its respective expansion orifice to clear any debris accumulating therein while allowing continued expansion of fluid across the flow barrier by leaving at least one other expansion orifice open.

* * * * *